US007467594B1

(12) United States Patent
Duquette et al.

(10) Patent No.: US 7,467,594 B1
(45) Date of Patent: Dec. 23, 2008

(54) PERSONAL WATERCRAFT WITH PIVOTABLE SEAT

(75) Inventors: Mathieu Duquette, Sherbrooke (CA); Maxime Valence, St-Hyacinthe (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 11/948,459

(22) Filed: Nov. 30, 2007

(51) Int. Cl.
*B63B 35/73* (2006.01)
*B63B 17/00* (2006.01)

(52) U.S. Cl. ..... 114/55.5; 114/363

(58) Field of Classification Search ..... 114/55.55
See application file for complete search history.

(56) References Cited

U.S. PATENT DOCUMENTS 5,603,281 A * 2/1997 Harvey et al. ..... 114/363
6,019,054 A * 2/2000 Hattori et al. ..... 114/55.57
6,880,483 B2 * 4/2005 Fedders ..... 114/363
7,124,703 B2 * 10/2006 Richard et al. ..... 114/363
7,343,869 B2 * 3/2008 Futaki ..... 114/363
2002/0073910 A1 * 6/2002 Yamada et al. ..... 114/363
2005/0016440 A1 * 1/2005 Simard et al. ..... 114/363

* cited by examiner

*Primary Examiner*—Jesús D Sotelo
(74) *Attorney, Agent, or Firm*—Osler, Hoskin & Harcourt LLP

(57) ABSTRACT

A personal watercraft is disclosed having a straddle-type seat. The seat is pivotally connected to the deck via a pivotal connection and pivotable with respect to the deck between a raised position and a lowered position. The pivotal connection has first and second links. The seat is pivotally connected to the first and second links and is pivotable with respect thereto about respective first and second axes. The first and second axes are movable with respect to the deck. When the seat is in the raised position, the seat permits access to the engine via an aperture in the deck. When the seat is in the lowered position, the seat covers the aperture in the deck and prevents access to the engine.

15 Claims, 21 Drawing Sheets

PERSONAL WATERCRAFT WITH PIVOTABLE SEAT

FIELD OF THE INVENTION

The present invention relates to personal watercraft, in particular to seats for personal watercraft.

BACKGROUND OF THE INVENTION

Most of today's commercially available personal watercraft have a hull and a deck disposed directly thereon. An engine and engine-related components are disposed in an engine compartment located between the hull and the deck. The deck has a pedestal onto which a straddle-type seat is disposed. While operating the watercraft, the driver and passengers sit on the seat and place their feet in footrests formed in recessed portions of the deck. When the watercraft is not in use, the seat is removable to allow access to the portion of the engine compartment disposed below the seat, via an opening in the deck, so that the engine and engine-related components can be serviced without having to remove the deck.

In an alternative arrangement, the whole deck is suspended above the hull. The engine, fuel tank, and propulsion system are still in and/or connected to the hull. A sub-deck is disposed on the hull to protect the components in the hull from water. The hull and sub-deck together form a hull and sub-deck (HSD) assembly. The deck is suspended on the HSD assembly. In this arrangement, the engine compartment is formed within the HSD assembly. The HSD assembly may include an opening through which the engine and other components may be accessed when either the seat or the deck is removed, without having to remove the sub-deck.

While these arrangements are adequate in providing access to the engine and other components, they have certain drawbacks. The seat of the watercraft is often large and heavy, making it cumbersome to remove and replace on the watercraft. This problem is exacerbated in multiple-passenger watercraft, which have longer and therefore heavier seats with complex shapes designed to align with and fit snugly on the deck. In addition, it is possible for a user to inadvertently damage the seat when removing it from the watercraft or replacing it on the watercraft, particularly if the seat is large and heavy.

Therefore, there is a need for a personal watercraft allowing convenient access to components of the watercraft located beneath the seat.

SUMMARY OF THE INVENTION

It is an object of the present invention to ameliorate at least some of the inconveniences present in the prior art.

It is also an object of the present invention to provide a personal watercraft allowing convenient access to components of the watercraft located beneath the seat.

It is also an object of the present invention to provide a personal watercraft having a pivotable seat, the seat allowing access to the engine of the watercraft when in a raised position.

In one aspect, the invention provides a personal watercraft comprising a hull. An engine is disposed generally in the hull. A propulsion system is connected to the hull and operatively connected to the engine. A helm assembly is operatively connected to the propulsion system. A deck is disposed above the hull. A straddle-type seat is disposed on the deck at least in part rearwardly of the helm assembly. The seat is pivotally connected to the deck via a pivotal connection and is pivotable with respect to the deck between a raised position having a raised seat angle and a lowered position having a lowered seat angle smaller than the raised seat angle. The pivotal connection has first and second links. The seat is pivotally connected to the first link and is pivotable with respect thereto about a first axis. The first axis is movable with respect to the deck. The seat is pivotally connected to the second link and is pivotable with respect thereto about a second axis. The second axis is generally parallel to and spaced apart from the first axis. The second axis is movable with respect to the deck. When the seat is in the raised position: the seat permits access to the engine via an aperture in the deck; the first axis is in a first position; and the second axis is in a second position. When the seat is in the lowered position: the seat covers the aperture in the deck and prevents access to the engine; the first axis is in a third position forward of the first position; and the second axis is in a fourth position forward of the second position.

In a further aspect, each of the first and second links has a first end and a second end. The first end of the first link is pivotally connected to the deck and is pivotable with respect thereto about a third axis. The second end of the first link is pivotally connected to the seat and is pivotable with respect thereto about the first axis. The first end of the second link is pivotally connected to the deck and is pivotable with respect thereto about a fourth axis. The fourth axis is generally parallel to the third axis. The fourth axis is disposed rearwardly of the third axis. The second end of the second link is pivotally connected to the seat and is pivotable with respect thereto about the second axis. The second axis is generally parallel to the first axis. The second axis is disposed rearwardly of the first axis.

In a further aspect, a sub-deck is disposed on the hull. The hull and sub-deck together form a hull and sub-deck (HSD) assembly. The engine is disposed in the HSD assembly. The deck is disposed above the sub-deck.

In a further aspect, the seat is pivotable to a toggle seat position. The toggle seat position has a toggle seat angle smaller than the raised seat angle and larger than the lowered seat angle. When the seat angle is larger than the toggle seat angle the seat does not pivot to a position having a seat angle smaller than the toggle seat angle under the force of its own weight.

In a further aspect, when the seat angle is larger than the toggle seat angle the weight of the seat urges the seat toward the raised position.

In a further aspect, when the seat angle is larger than the toggle seat angle the seat does not pivot to a seat position having a seat angle smaller than the toggle seat angle in the absence of an upward vertical force exerted thereon.

In a further aspect, when the seat angle is smaller than the toggle seat angle the seat pivots to the lowered position under the force of its own weight.

In a further aspect, a gas spring is operatively connected between the seat and the deck. The gas spring exerts an upward force on the seat at least when the seat angle is smaller than the toggle seat angle.

In a further aspect, a gas spring is operatively connected between the seat and the deck. The gas spring exerts an upward force on the seat greater than the downward force exerted by the weight of the seat.

In a further aspect, a gas spring is operatively connected between the seat and the deck. When the seat is in the raised position the gas spring prevents the seat from pivoting to a seat position having a seat angle greater than the raised seat angle.

In a further aspect, when the seat is in the raised position the first and second links prevent the seat from pivoting to a seat position having a seat angle greater than the raised seat angle.

In a further aspect, at least one compressible stop is mounted to one of the seat and the deck. When the seat is in the lowered position the at least one stop abuts against the other of the seat and the deck.

In a further aspect, the at least one stop is compressed by the seat when the seat is in the lowered position.

In a further aspect, the at least one stop supports the majority of the weight of the seat when the seat is in the lowered position.

In a further aspect, a rear portion of the seat has one of a male latch component and a female latch component. A rear portion of the deck has the other of the male latch component and the female latch component. The female latch component receives the male latch component when the seat is in the lowered position, thereby preventing the seat from moving to the raised position.

For purposes of this application, terms related to spatial orientation such as forwardly, rearwardly, left, and right, are as they would normally be understood by a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
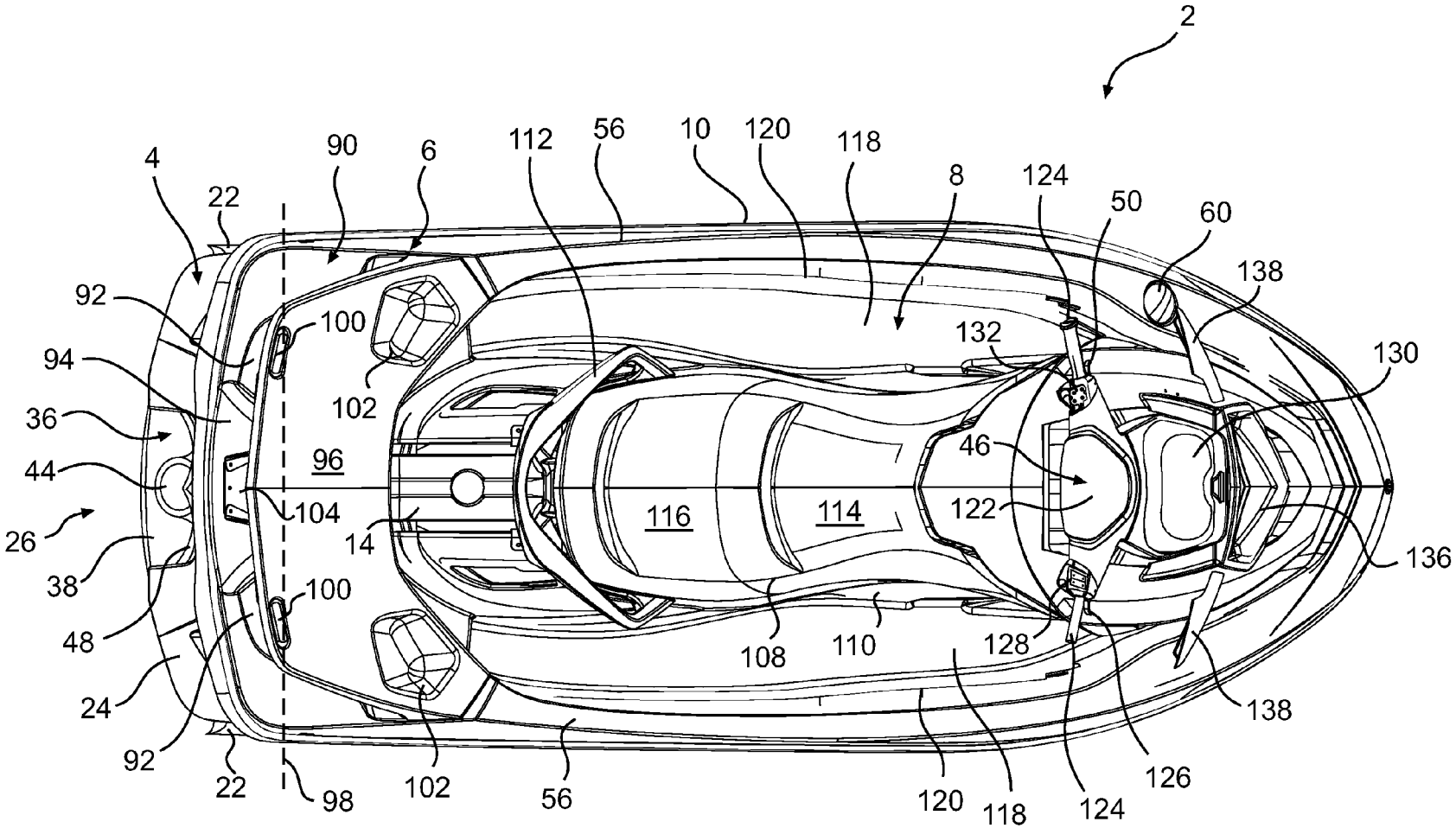
FIG. 5 is a perspective view, taken from a top, rear side, of the watercraft of FIG. 1.
Figure 6:
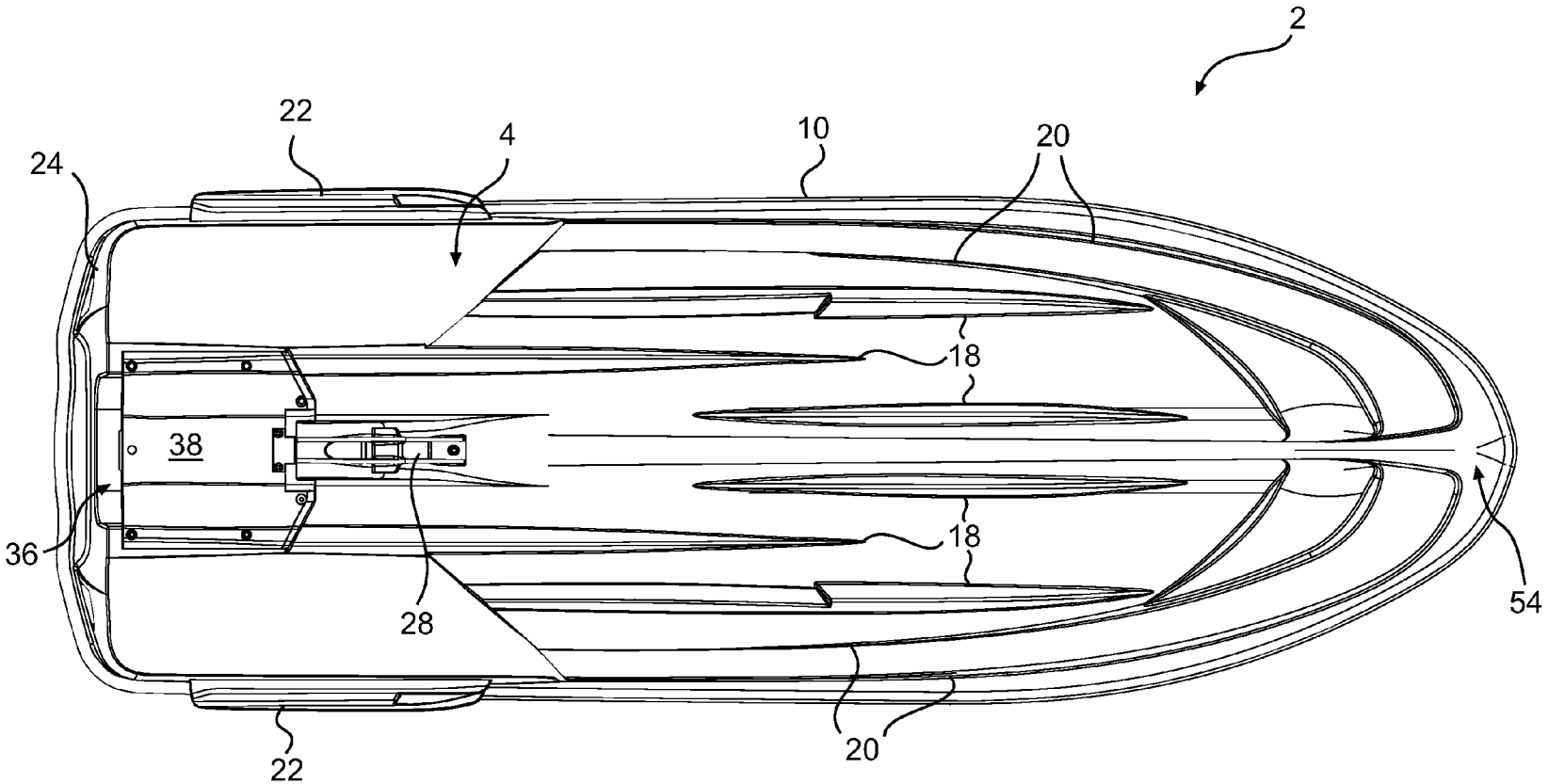
FIG. 6 is a bottom plan view of the watercraft of FIG. 1.
Figure 7:
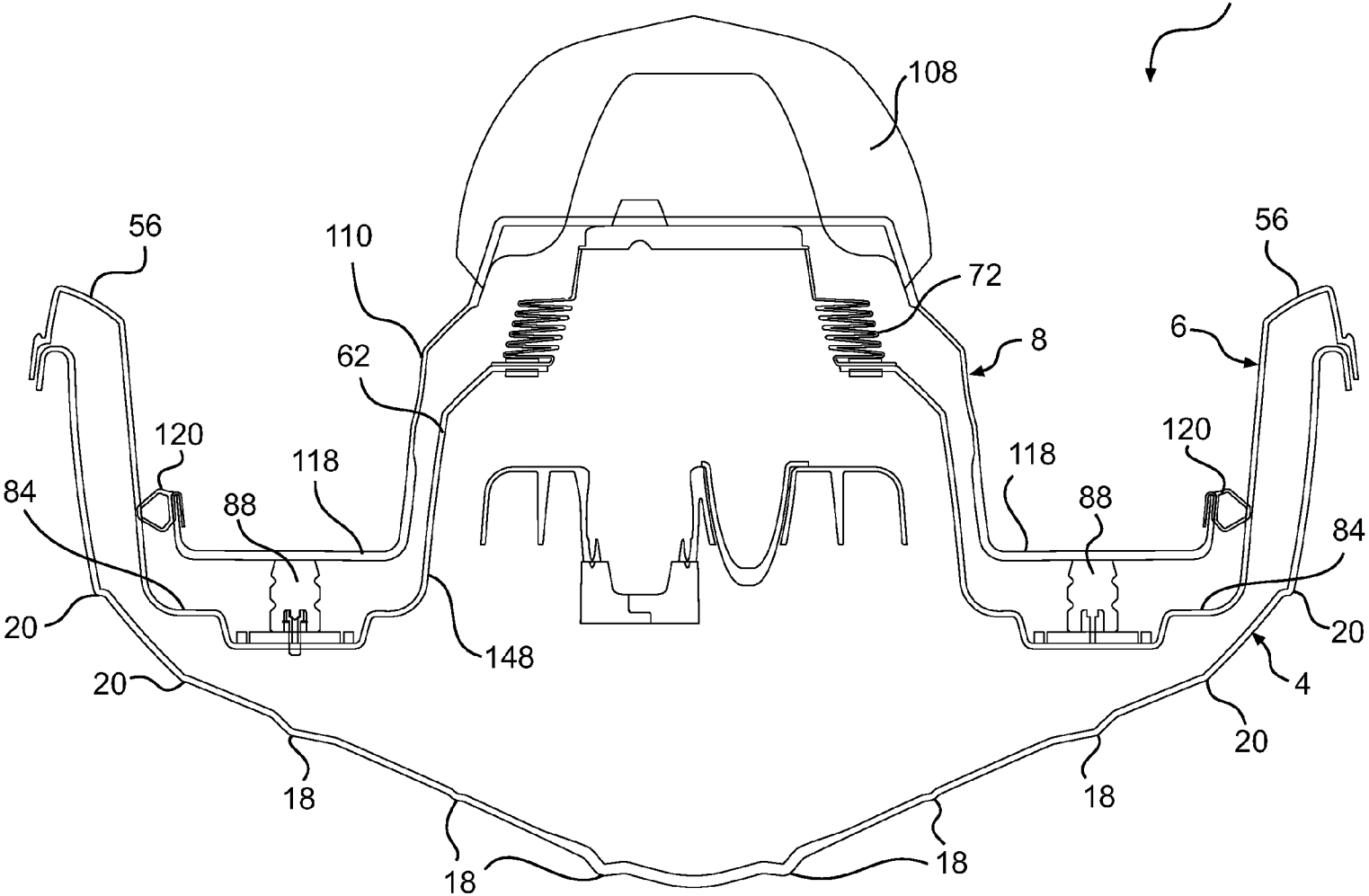
FIG. 7 is a schematic view of a transverse cross-section of the watercraft of FIG. 1.
Figure 8:
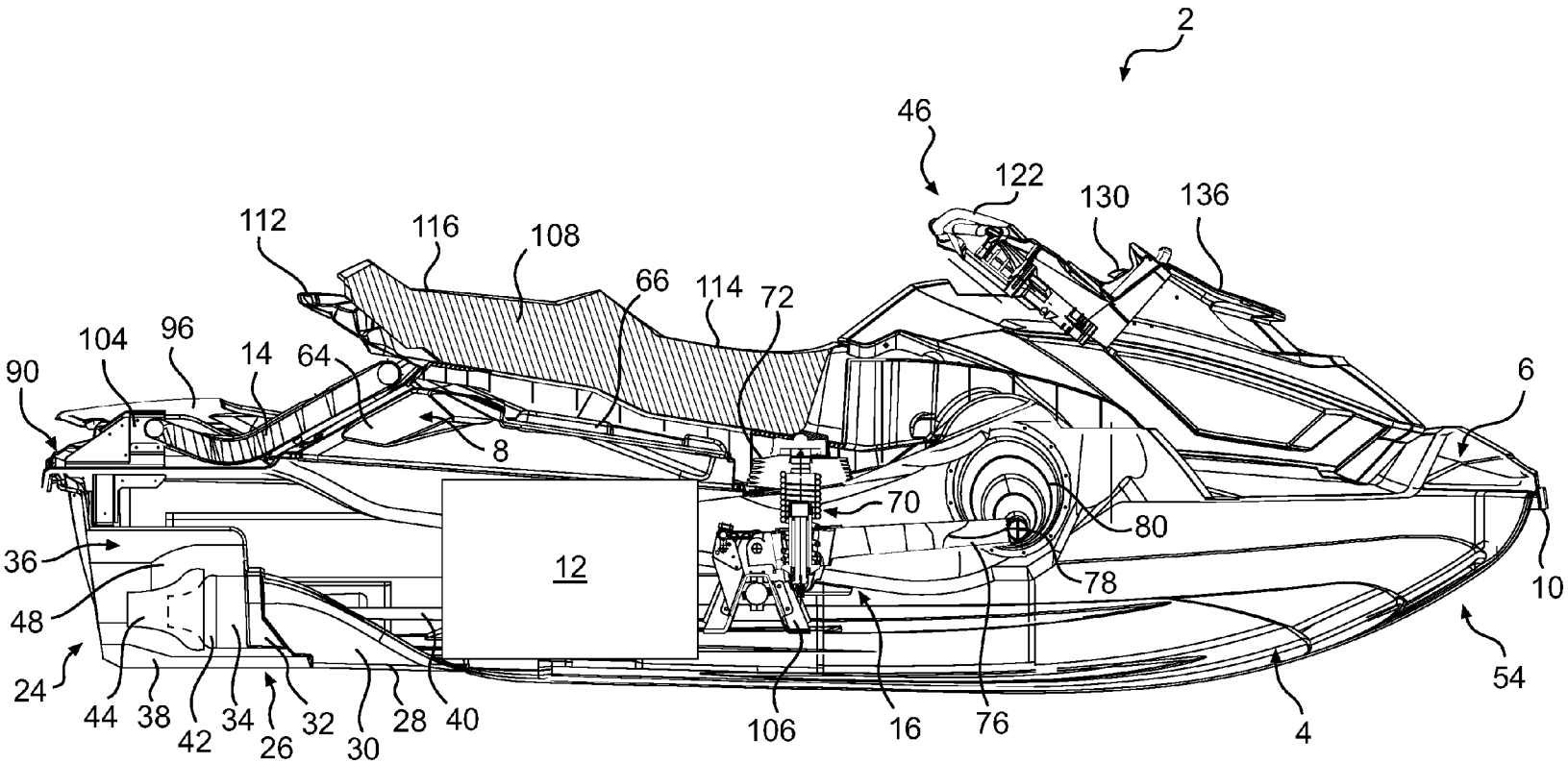
FIG. 8 is a partial longitudinal cross-section of the watercraft of FIG. 1 showing some of the internal components thereof.
Figure 9:
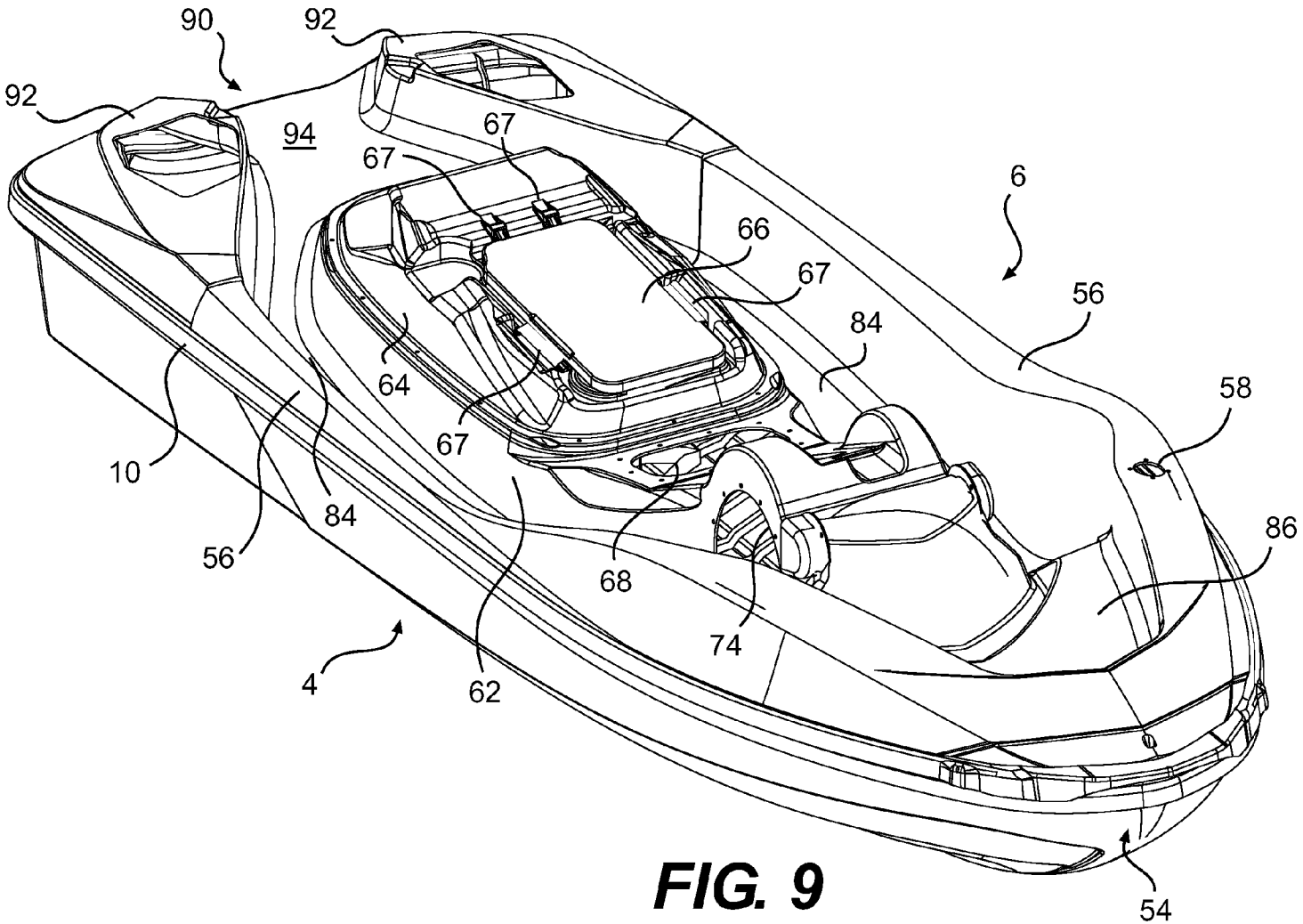
FIG. 9 is a perspective view, taken from a front, right side, of a hull and sub-deck assembly of the watercraft of FIG. 1, with the engine cowling thereon.
Figure 10:
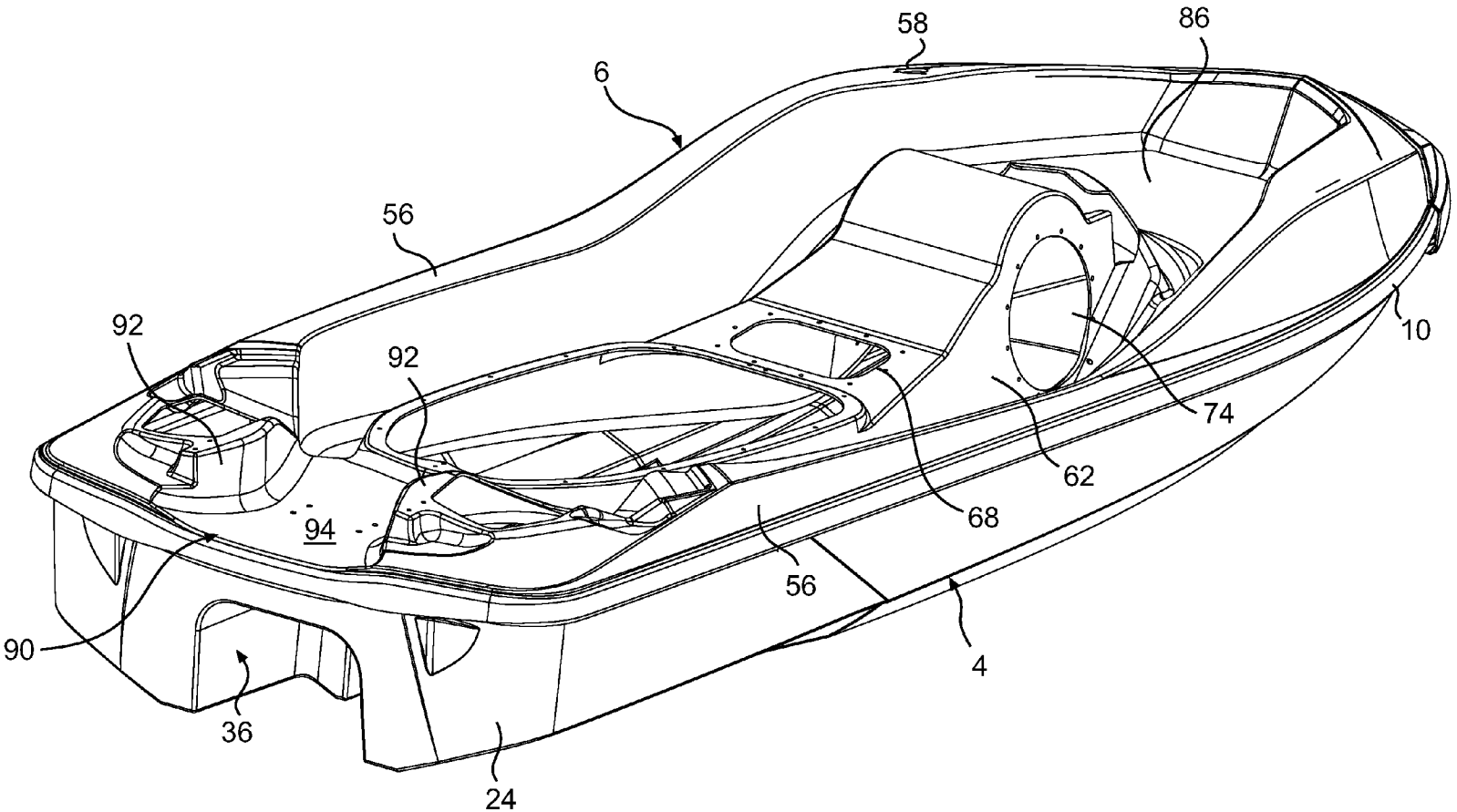
FIG. 10 is a perspective view, taken from a rear, right side, of the hull and sub-deck assembly of FIG. 9, with the engine cowling removed.
Figure 11:
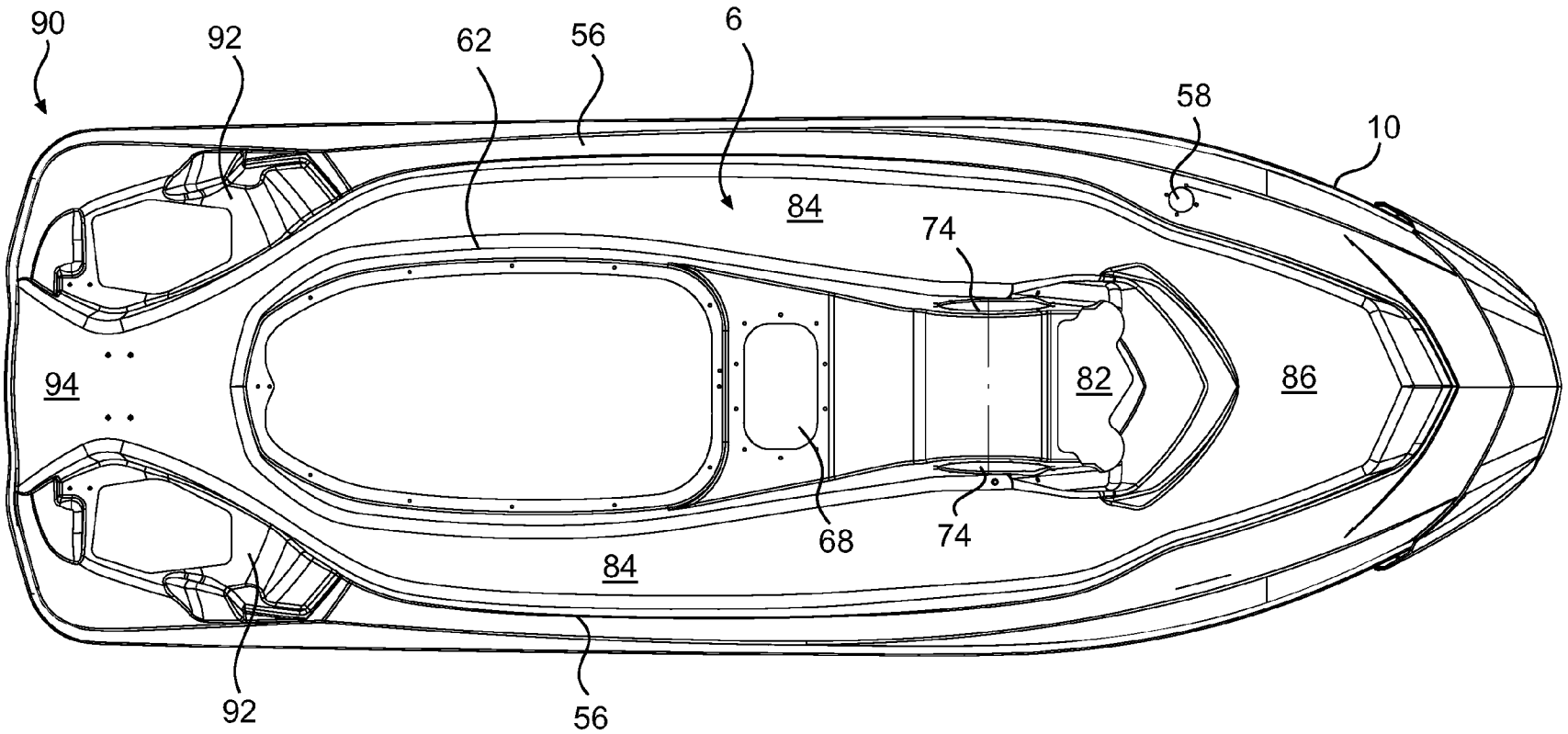
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. It is contemplated that the deck 8 could be fixedly connected to the HSD assembly.

Figure 1:
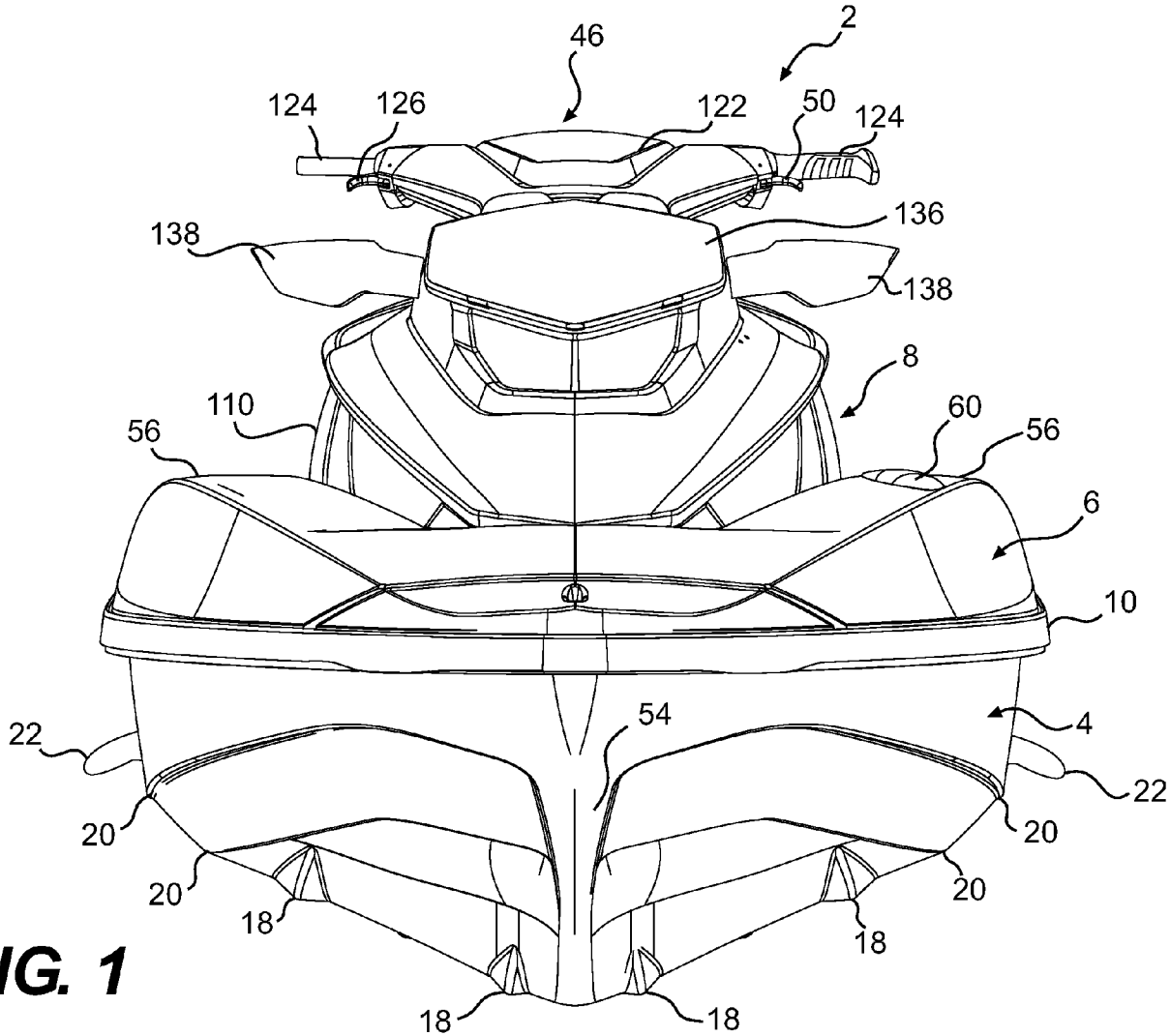
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
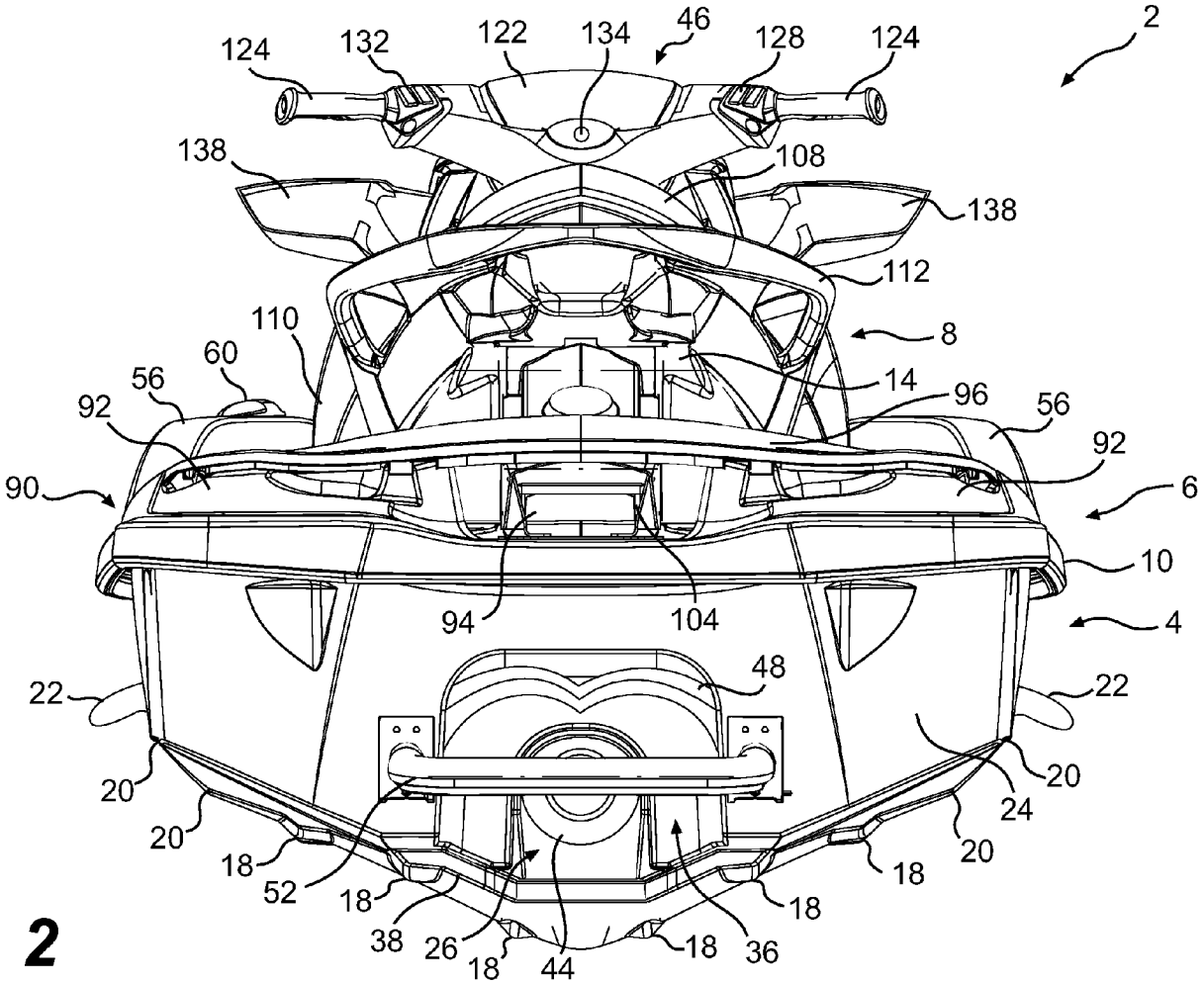
FIG. 2 is a rear elevation view of the watercraft of FIG. 1.
Figure 3:
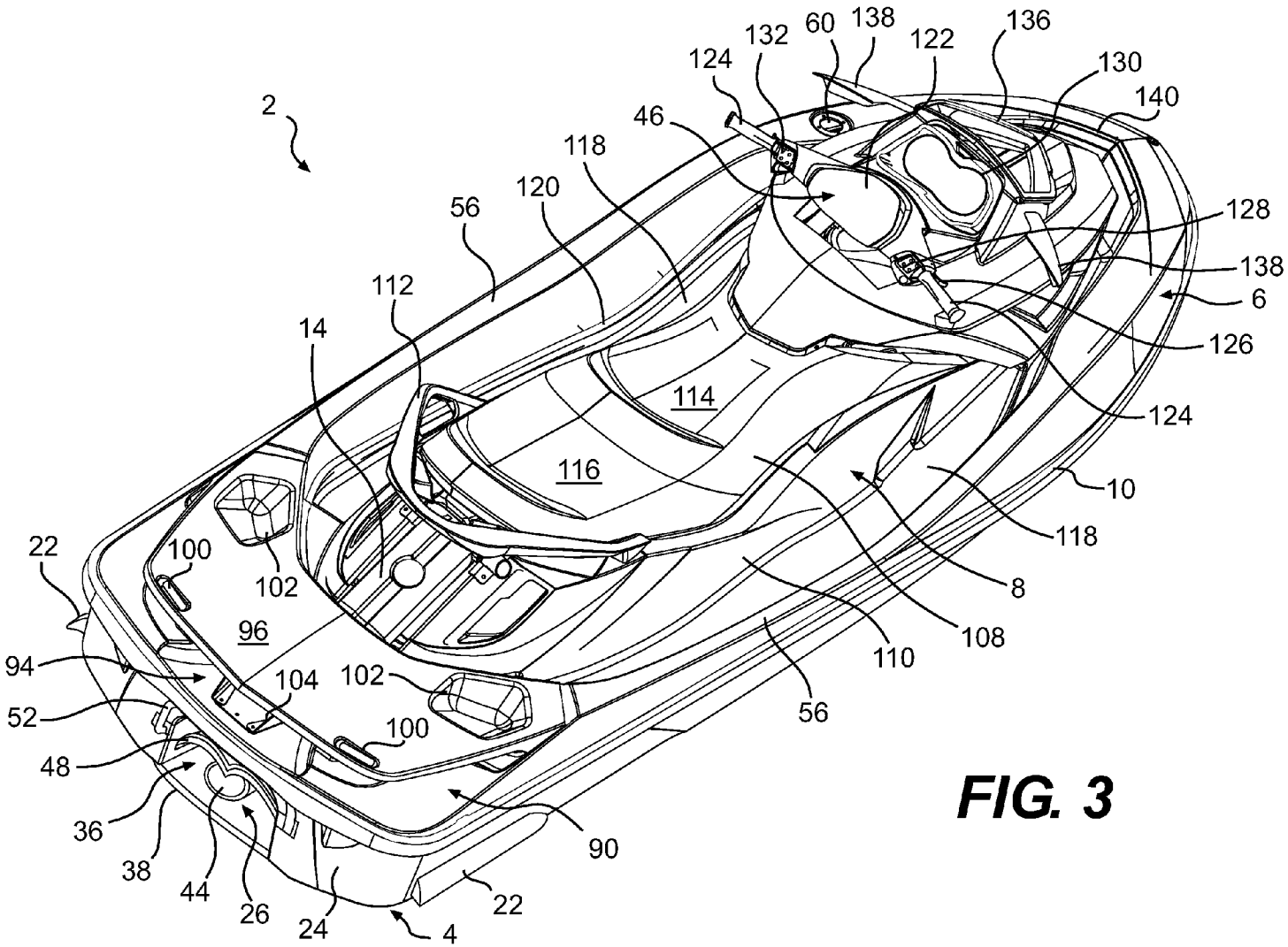
FIG. 3 is a perspective view, taken from a rear, right side, of the watercraft of FIG. 1.
Figure 4:
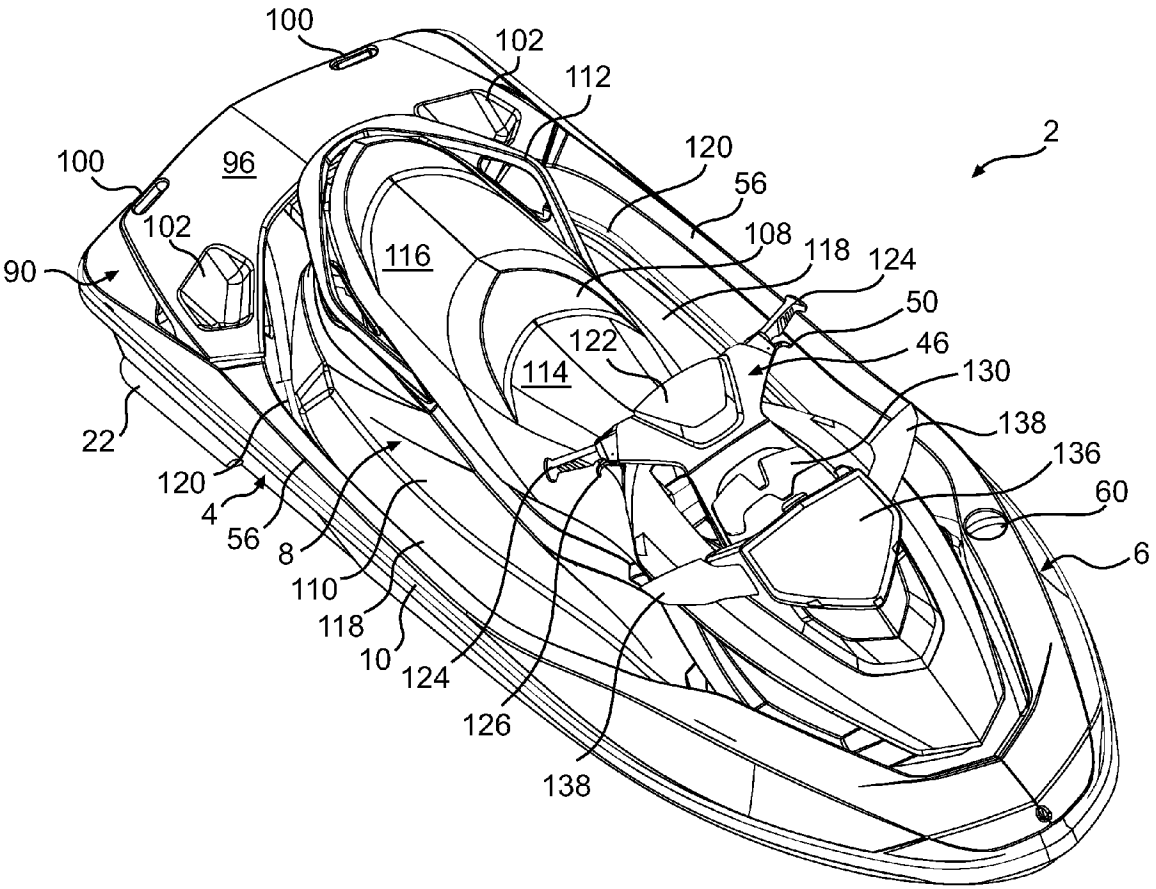
FIG. 4 is a perspective view, taken from a front, right side, of the watercraft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom to facilitate boarding 24 the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refuelling opening 58 is provided on the front left gunnel 56. A hose (not shown) extends from the refuelling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refuelling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6 and a seal is disposed between the engine cowling 64 and the remainder of the sub-deck 6 to prevent water intrusion. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear portion of the pedestal 62 below the engine cowling 64 to provide an attachment point for towing a water-skier or an inflatable device for example.

An opening 68 is provided in the upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. The suspension elements 70 can include, but are not limited to, one or more springs and a hydraulic gas spring. It is contemplated that the suspension assembly 16 could include a single suspension element. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on the sides of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are connected to the sub-deck 6 around the openings 74 at one end thereof and are connected around brackets (not shown) that are attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increases the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94. When the watercraft 2 moves forward, the bow 54 raises, thus raising the side channels 84. This permits any water accumulated in the side channels 84 to drain through the rear channel 94.

Figure 12:
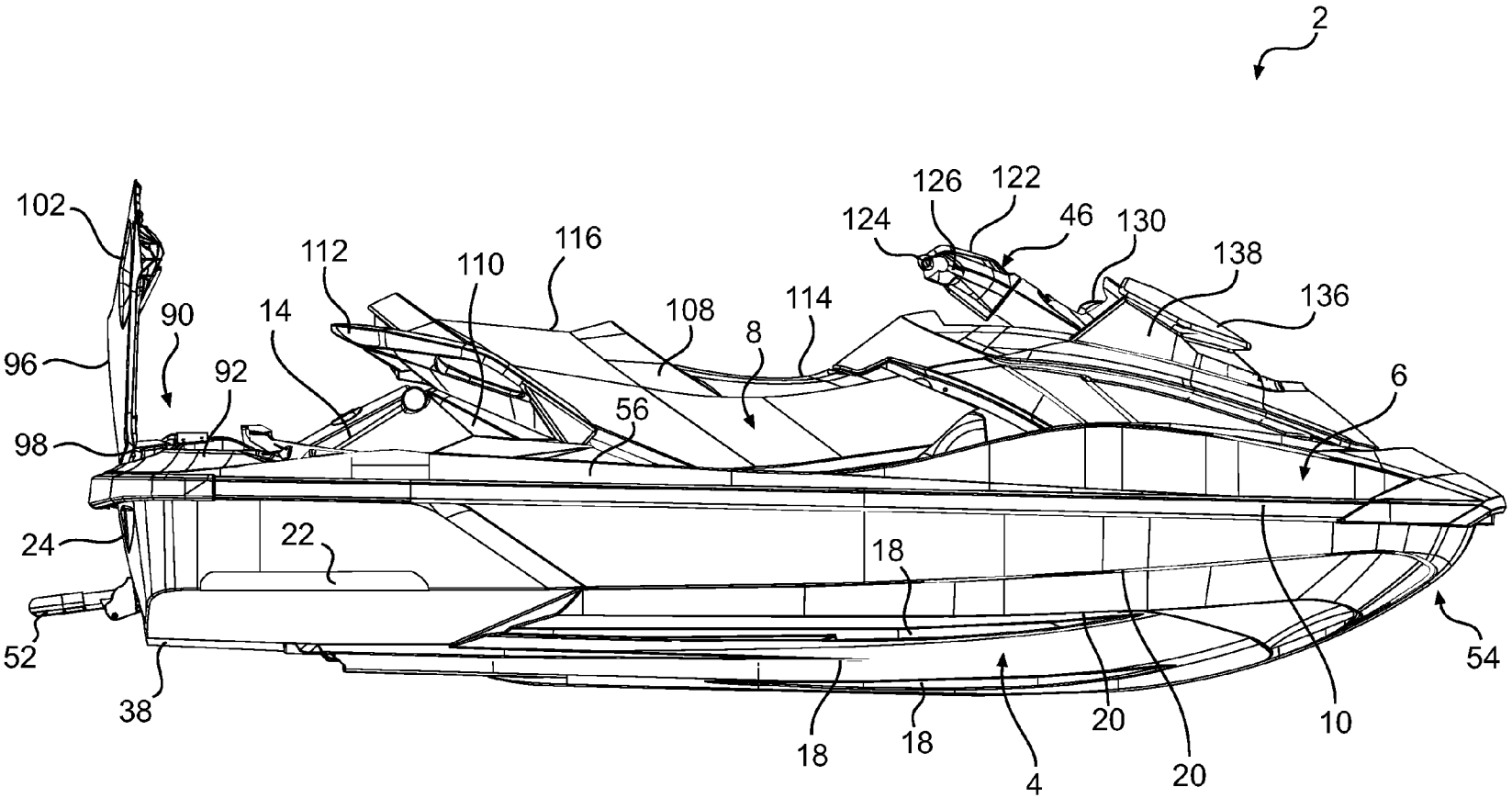
FIG. 12 is a side elevation view of the watercraft of FIG. 1 with a rear platform thereof in a raised position.

A rear platform 96 is pivotally connected on the rear portion 90 of the sub-deck 6. The platform 96 preferably pivots about an axis 98 (FIGS. 5 and 12) located near the transom 24 and extending laterally across the sub-deck 6. It is contemplated that the platform 96 could alternatively pivot about an axis located near the front of thereof and extending laterally across the sub-deck 6. It is also contemplated that the platform 96 could alternatively pivot about an axis extending generally parallel to a longitudinal axis of the watercraft 2 and disposed near a lateral side of the platform 96. When the rear platform 96 is in a raised position, as shown in FIG. 12, it permits access to the storage compartments 92. When the rear platform 96 is in a lowered, horizontal position, as shown in FIGS. 2 to 5, the rear platform 96 closes and seals the storage compartments 92, thus eliminating the need of separate lids to accomplish this function. In the lowered position, the rear platform 96 provides a surface on which the driver or passengers can stand when the watercraft 2 is at rest. Two recesses in the rear platform 96 form hand grips 100 which a person can grab to assist themselves when reboarding the watercraft 2 from the water. Two more recesses in the rear platform 96 form heel rests 102 which a passenger sitting on the watercraft 2 facing rearwardly, for spotting a water-skier being towed by the watercraft 2 for example, can use to place their heels to provide them with additional stability. Carpeting made of a rubber-type material preferably covers the rear platform 96 to provide additional comfort and feet traction on the rear platform 96.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to a bracket 106 on the bottom of the hull 4. Suspension elements 70 are connected at their lower ends to the front suspension arm 76 forwardly of the bracket 106 and extend upwardly to connect to the under side of the deck 8 at their upper ends. The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

As seen in FIGS. 1 to 5, the deck 8 has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a pivotal connection and is connected at the rear thereof by a latch assembly 182. The seat 108 selectively covers an opening 140, defined by a top portion of the pedestal 110, which provides access to the air intake unit 66, which once removed, provides access to the upper portion of the engine 12. The pivotal connection of the seat 108 will be described below in further detail.

Located on either side of the pedestal 110, between the pedestal 110 and the gunnels 56 of the sub-deck 6, are a pair of generally horizontal footrests 118 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber, that can compress and expand to follow the inner side of the gunnels 56 as the HSD assembly moves relative to the deck 8. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122 that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Turning to FIGS. 13 to 19, the pivotal connection of the seat 108 will now be described in further detail according to a first embodiment.

Figure 13:
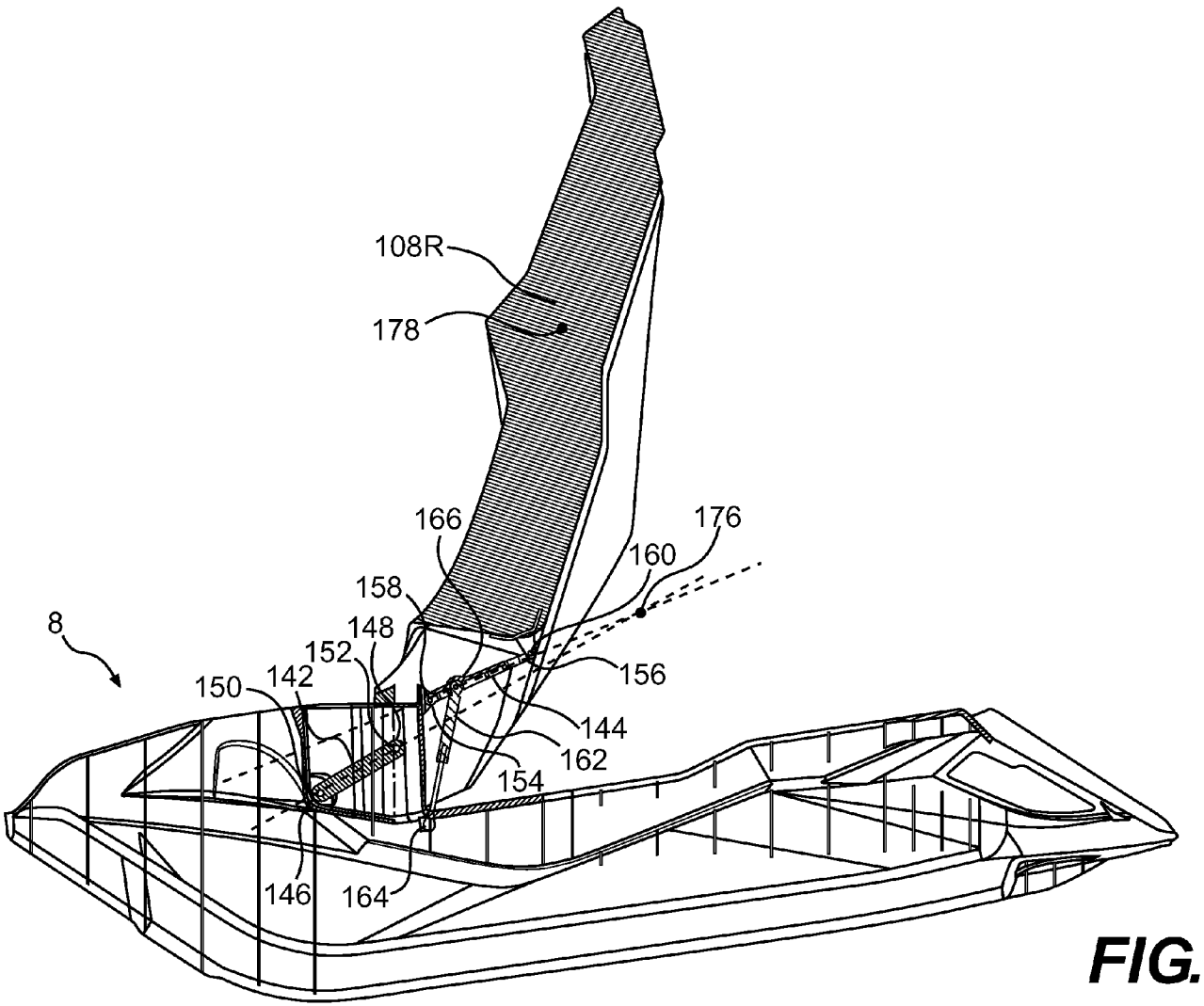
FIGS. 13 and 14 are partial cross-sectional views, taken from the left side, of the deck of the watercraft of FIG. 1, showing the seat in raised and lowered positions, respectively.
Figure 14:
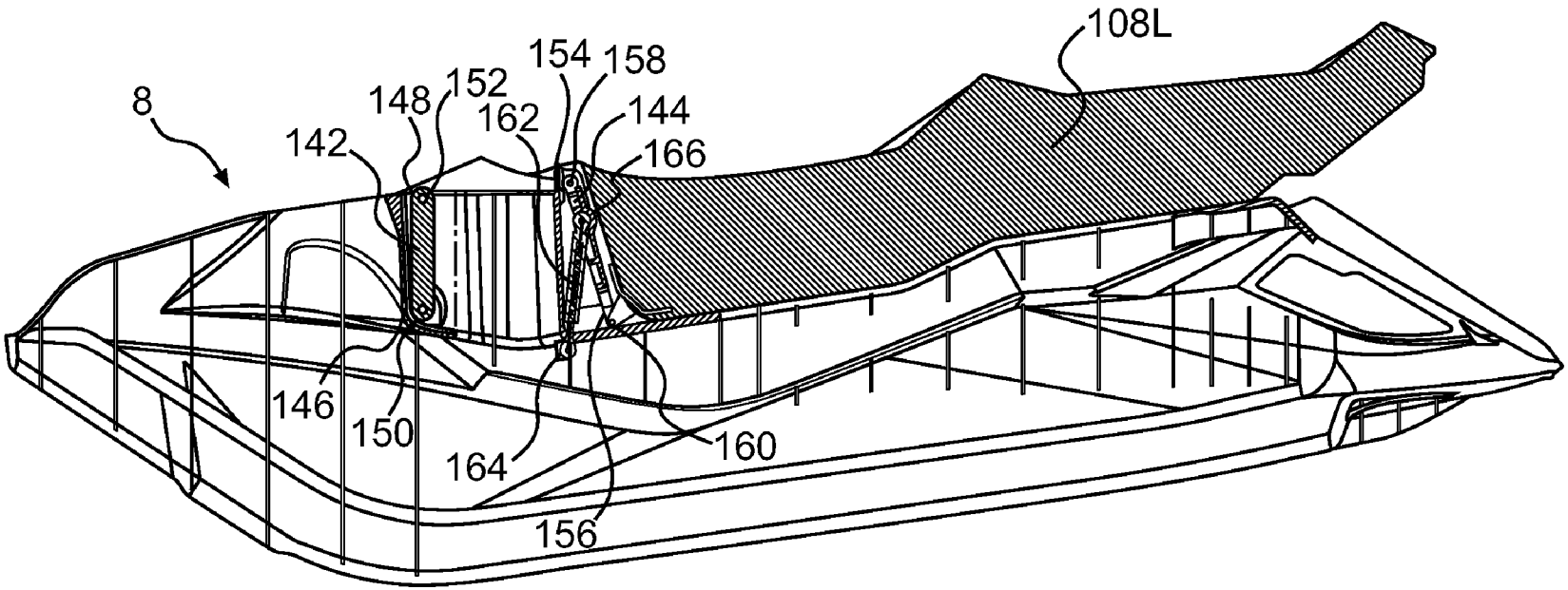
Figure 15:
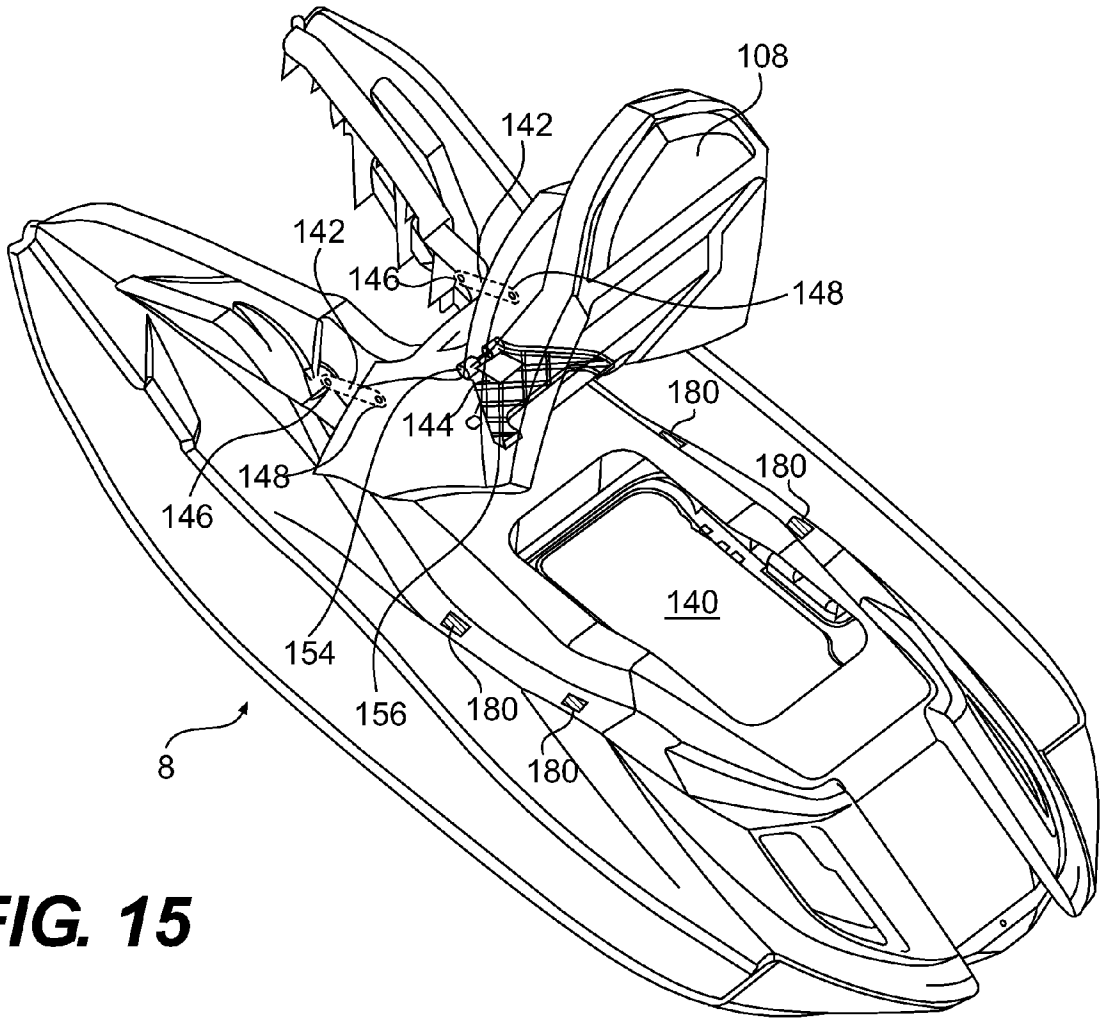
FIG. 15 is a perspective view, taken from a left rear side, of the deck of the watercraft of FIG. 1 with the seat in the raised position.

Referring to FIGS. 13 and 14, the seat 108 is pivotally connected to the deck 8 via a pivotal connection that will be described in further detail below. The seat 108 can be pivoted relative to the deck 8 between a raised position 108R (shown in FIG. 13) and a lowered position 108L (shown in FIG. 14). When the seat 108 is in the raised position 108R, the opening 140 in the top portion of the pedestal 110 is uncovered as shown in FIG. 15. When uncovered, the opening 140 allows access to the air intake unit 66, which once removed through the opening 140, provides access to the upper portion of the engine 12 through the opening 140, thereby allowing at least a portion of the engine 12 to be serviced without removing the deck 8 and sub-deck 6. The seat 108 preferably pivots by an angle of at least about 60 degrees between the lowered position 108L and the raised position 108R, to allow unobstructed access to the engine 12. The seat 108 covers the opening 140 when it is in the lowered position 108L, and allows one or more riders to sit on the seat 108.

Figure 17:
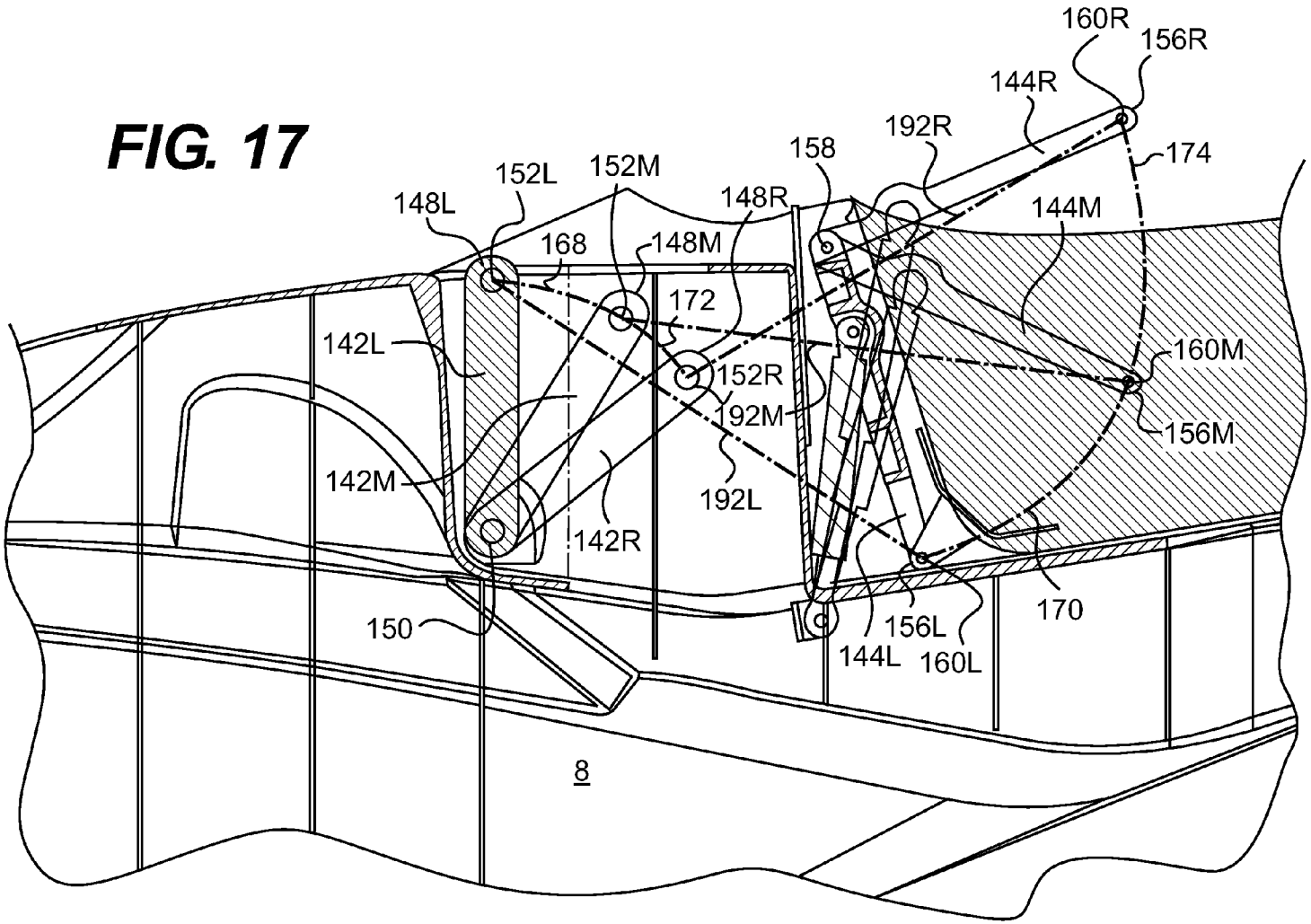
FIG. 17 is a cross-sectional view, taken from the left side, of the seat linkage of the watercraft of FIG. 1 according to a first embodiment of the invention, showing three positions of the seat linkage in superposition.

Referring now to FIGS. 13-15, the connection between the seat 108 and the deck 8 will now be described according to a first embodiment of the invention. The seat 108 is connected to the deck 8 via two laterally-spaced forward links 142 and a rearward link 144. Each forward link 142 is pivotally connected to the deck 8 at one end 146 and pivotally connected to the seat 108 at the other end 148. Both forward links 142 pivot with respect to the deck 8 about a common axis 150 and pivot with respect to the seat 108 about a common axis 152. It is contemplated that either a single forward link 142 or more than two forward links 142 having common pivot axes may be used. A single rearward link 144 is pivotally connected to the deck 8 at one end 154 and pivotally connected to the seat 108 at the other end 156. Referring to FIG. 15, the A-shape of the rearward link 144 provides lateral stability to the seat. It is contemplated that a differently-shaped rearward link 144 may alternatively be used, and that two or more rearward links 144 may alternatively be used. The rearward link 144 pivots with respect to the deck 8 about the axis 158 and pivots with respect to the seat 108 about the axis 160. Referring to FIG. 17, when the seat 108 is in the lowered position, the axis 158 is disposed above and rearwardly of the axis 150, and the axis 160 is disposed below and rearwardly of the axis 152. The four axes 150, 152, 158, 160 are generally parallel.

A gas spring 162 is operatively connected between the seat 108 and the deck 8. In the illustrated embodiment, the gas spring 162 is connected at its lower end 164 to the deck 8 and at its upper end 166 to the rearward link 144. The gas spring 162 increases in length as the seat 108 is pivoted toward the raised position 108R and decreases in length as the seat 108 is pivoted toward the lowered position 108L. The gas spring 162 reduces the force required by a user to pivot the seat 108 from the lowered position 108L to the raised position 108R. The gas spring 162 additionally limits the upward movement of the seat 108 beyond the raised position 108R, as will be described below in further detail. It is contemplated that the gas spring 162 may alternatively be operatively connected between the seat 108 and the deck 8 in other ways, and any arrangement in which the length of the gas spring 162 changes as the seat 108 moves relative to the deck 8 should be understood as an operative connection between the seat 108 and the deck 8. Alternative examples of operative connections include connecting the upper end 166 of the gas spring 162 to either the forward link 142 or to the seat 108, while leaving the lower end 164 of the gas spring 162 connected to the deck 8. Further operative connections are contemplated wherein the upper end 166 of the gas spring 162 is connected to the seat 108 and the lower end 164 of the gas spring is connected to either the forward link 142 or the rearward link 144.

Figure 16:
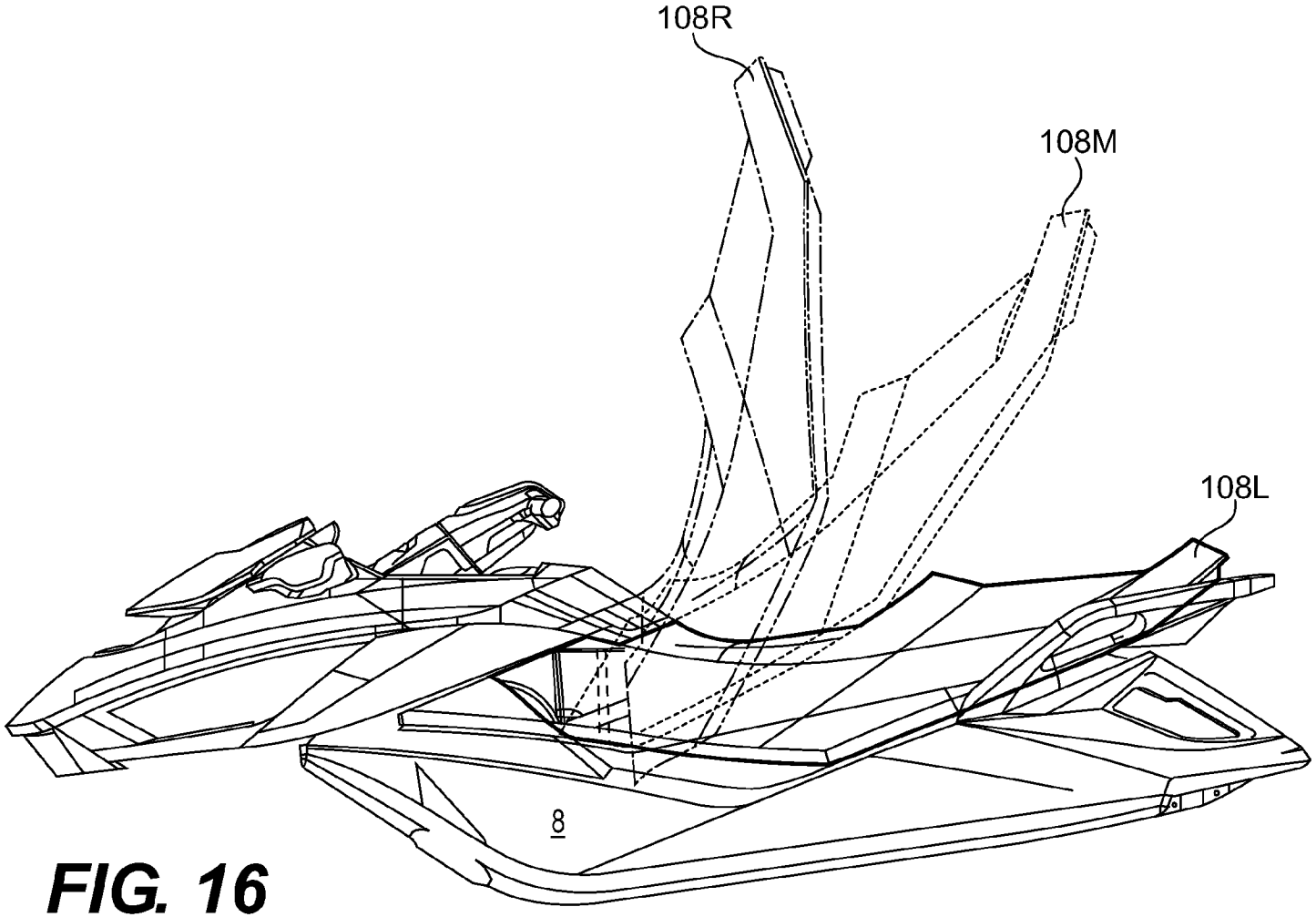
FIG. 16 is a left side elevation view of the deck of the watercraft of FIG. 1, showing three positions of the seat in superposition.

Referring now to FIGS. 16 and 17, the pivotal movement of the links 142 and 144 and the seat 108 will be described in detail.

Referring to FIG. 16, the seat 108 is shown in superposition in a raised position 108R, a middle position 108M and a lowered position 108L. Referring to FIG. 17, the forward link 142 and the rearward link 144 are shown in raised, middle and lowered positions corresponding respectively to the seat positions shown in FIG. 16, and have been similarly relabeled using the letters R, M and L in FIG. 17.

Referring to FIG. 17, the positions of the seat 108 can be understood in terms of the seat angle of the seat 108. For this purpose, any convenient fixed points on the seat 108 can be used as a reference, such as the angle of an imaginary line 192 passing through the axis 152 and the axis 160. The line 192 is shown in three positions, 192L, 192M and 192R, corresponding respectively to the three seat positions 108L, 108M and 108L. For the purposes of the present application, the angle of the line 192 when the seat 108 is in the lowered position 108L will be used as a reference angle, and the seat angles of all other seating positions will be described as angular displacements from the reference angle. In general, a seat position having a larger seat angle will be considered "above" a position having a smaller seat angle. Similarly, a seat position having a smaller seat angle will be considered "below" a position having a larger seat angle.

Referring generally to FIGS. 16 and 17, when the seat 108 is pivoted from the lowered position 108L toward the middle position 108M, the end 148 of the forward link 142 moves along the arc 168 from position 148L to position 148M. At the same time, the end 156 of the rearward link 144 moves along the arc 170 from position 156L to position 156M. Because the arc 168 is nearly horizontal, particularly at the end nearest position 148L, and the arc 170 slopes upwardly from position 156L to position 156M, the forward portion of the seat 108 initially moves substantially rearwardly as the rearward portion of the seat 108 is raised from the lowered position 108L, and its initial downward movement is minimized. This movement of the seat 108 allows sufficient clearance between the seat 108 and the deck 8 for the forward tip of the seat 108 to rotate freely without its path being obstructed by the deck 8.

As the seat 108 continues to rotate from the middle position 108M toward the raised position 108R, the end 148 of the forward link 142 moves along the arc 172 from position 148M to position 148R. At the same time, the end 156 of the rearward link 144 moves along the arc 174 from position 156M to position 156R. In the raised position 108R, the seat 108 is preferably pivoted at least 60 degrees with respect to the lowered position 108L, to allow unobstructed access to the engine compartment. The geometry of the links 142, 144 may additionally limit the range of motion of the seat 108 so that it does not pivot past the raised position 108R. Alternative mechanisms for limiting the range of motion of the seat 108 beyond the raised position 108R will be discussed below.

Referring now to FIG. 17, because the seat 108 pivots concurrently about the forward link 142 and the rearward link 144, the seat 108 rotates simultaneously about the two axes of rotation 152 and 160. Because both axes of rotation 152 and 160 are themselves moving as the seat 108 pivots, no single point on the seat 108 is fixed in position as the seat 108 is pivoted from the lowered position 108L to the raised position 108R. The characteristics of the pivotal movement of the seat 108 can be better understood in terms of the instantaneous center of rotation 176 (shown in FIG. 18), which is defined as the geometric point about which the seat 108 is rotating at any particular instantaneous position along its path. As will be explained below, the instantaneous center 176 itself moves as the seat 108 pivots between the lowered position 108L and the raised position 108R.

Figure 18:
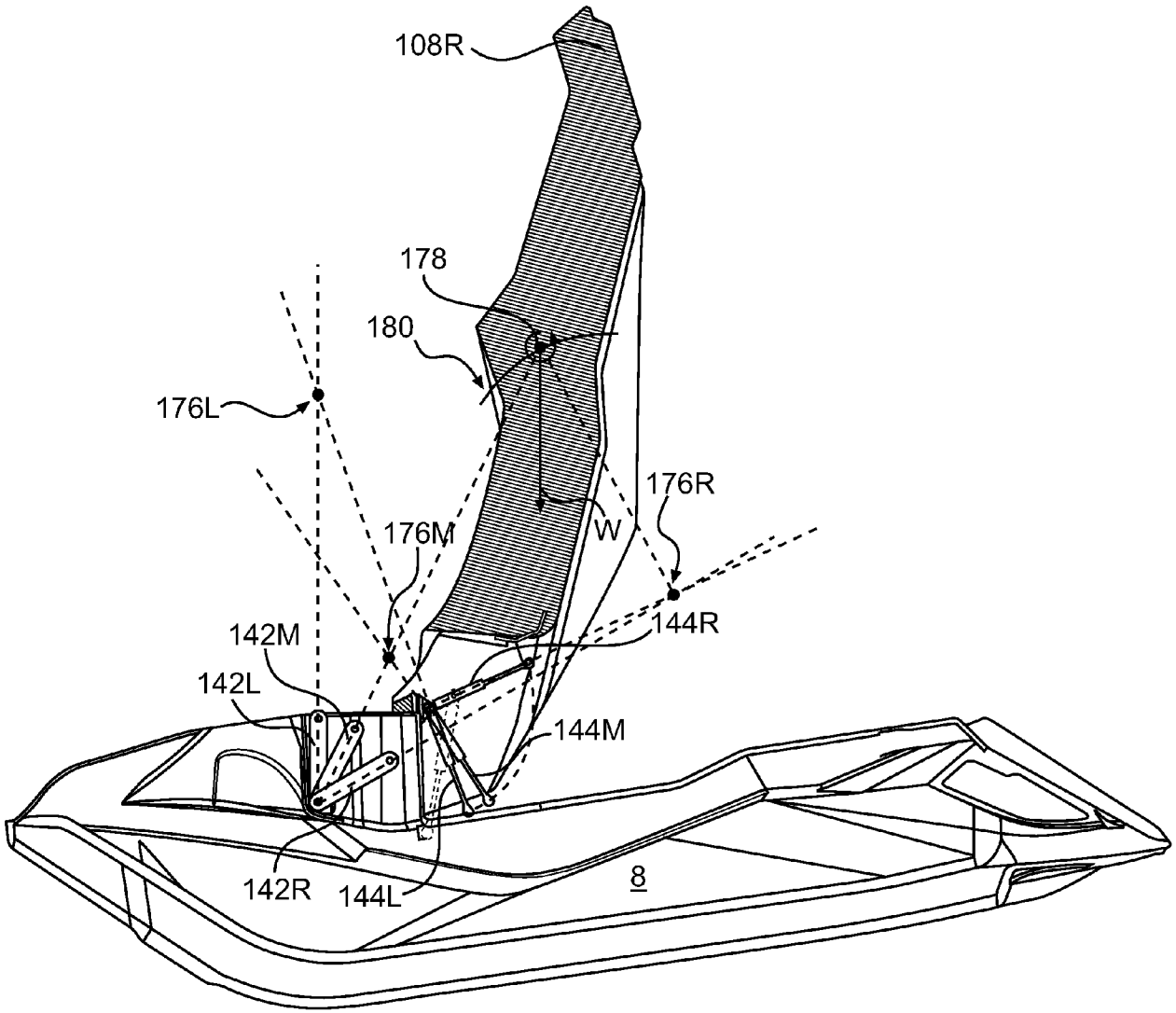
FIG. 18 is a schematic view of the deck of the watercraft of FIG. 1, showing three positions of the seat linkage of FIG. 17 in superposition and showing the seat in the raised position.

Referring to FIG. 18, the location of the instantaneous center 176 can be determined by geometry, using the principle that the path of every point on the body is instantaneously tangential to a line passing through that point and the instantaneous center 176. Two such points, whose paths are convenient to determine, are the axes of rotation 152 and 160. The axis of rotation 152 corresponds to a first point on the seat 108 that is constrained by the link 142 to move in the direction tangential to the longitudinal axis of the link 142. Similarly, the axis of rotation 160 corresponds to a second point on the seat 108 that is constrained by the link 144 to move in the direction tangential to the longitudinal axis of the link 144. Therefore, the longitudinal axes of the links 142 and 144 both pass through the instantaneous center 176, and the instantaneous center 176 must be located at the point where the longitudinal axes of the links 142 and 144 intersect. For every seat position between 108L and 108R inclusive, the location of the instantaneous center 176 can be determined by extending the longitudinal axes of the links 142 and 144 along imaginary lines and identifying the point where the lines intersect. Referring to FIG. 18, the instantaneous centers 176L, 176M and 176R are shown, corresponding to the seat positions 108L, 108M and 108R of FIG. 16 respectively.

Referring to FIG. 18, the seat 108 is shown in the raised position 108R. In this position, the center of gravity 178 of the seat 108 is positioned forward of the instantaneous center 176R, and is instantaneously rotating about the arc 180 having the point 176R as its center. The weight W of the seat 108 acts downwardly on the seat 108 at the center of gravity 178. Because the center of gravity 178 is forward of the instantaneous center 176R, the center of gravity 178 of the seat 108 moves slightly forward and downward as the seat 108 approaches the raised position 108R. In addition, when the seat 108 is in the raised position 108R, the weight W creates a forward moment (counter-clockwise, as seen in FIG. 18) about the instantaneous center 176R that prevents the seat 108R from moving to the position 108L under the force of its own weight. In order to move the seat 108R to the position 108L, the center of gravity 178 must initially move both upwardly and rearwardly as it rotates about the instantaneous center 176R. Thus, when the seat 108R is in the raised position it can only be lowered by the rider exerting thereon an upward and rearward force. In the absence of such a force, the seat 108R will remain stable in the raised position, even when the watercraft 2 is subjected to the impact of waves from the body of water.

Still referring to FIG. 18, the positions of the forward link 142L and rearward link 144L are shown corresponding to the seat 108 being in the lowered position 108L. The positions of the forward link 142M and rearward link 144M are shown corresponding to the seat 108 being in the middle position 108M. In these positions, the respective instantaneous centers 176L and 176M are forward of the center of gravity 178 of the seat 108. When the seat 108 is in the middle position 108M, the moment exerted by its weight about the instantaneous center 176M will tend to move the seat 108 toward the lowered position 108L. The gas spring 162, best seen in FIG. 13, partially resists the movement of the seat 108 from the middle position 108M to the lowered position 108L, thereby preventing the seat 108 from slamming shut in the lowered position 108L and potentially causing damage to the seat 108 or other portions of the watercraft 2.

Figure 20:
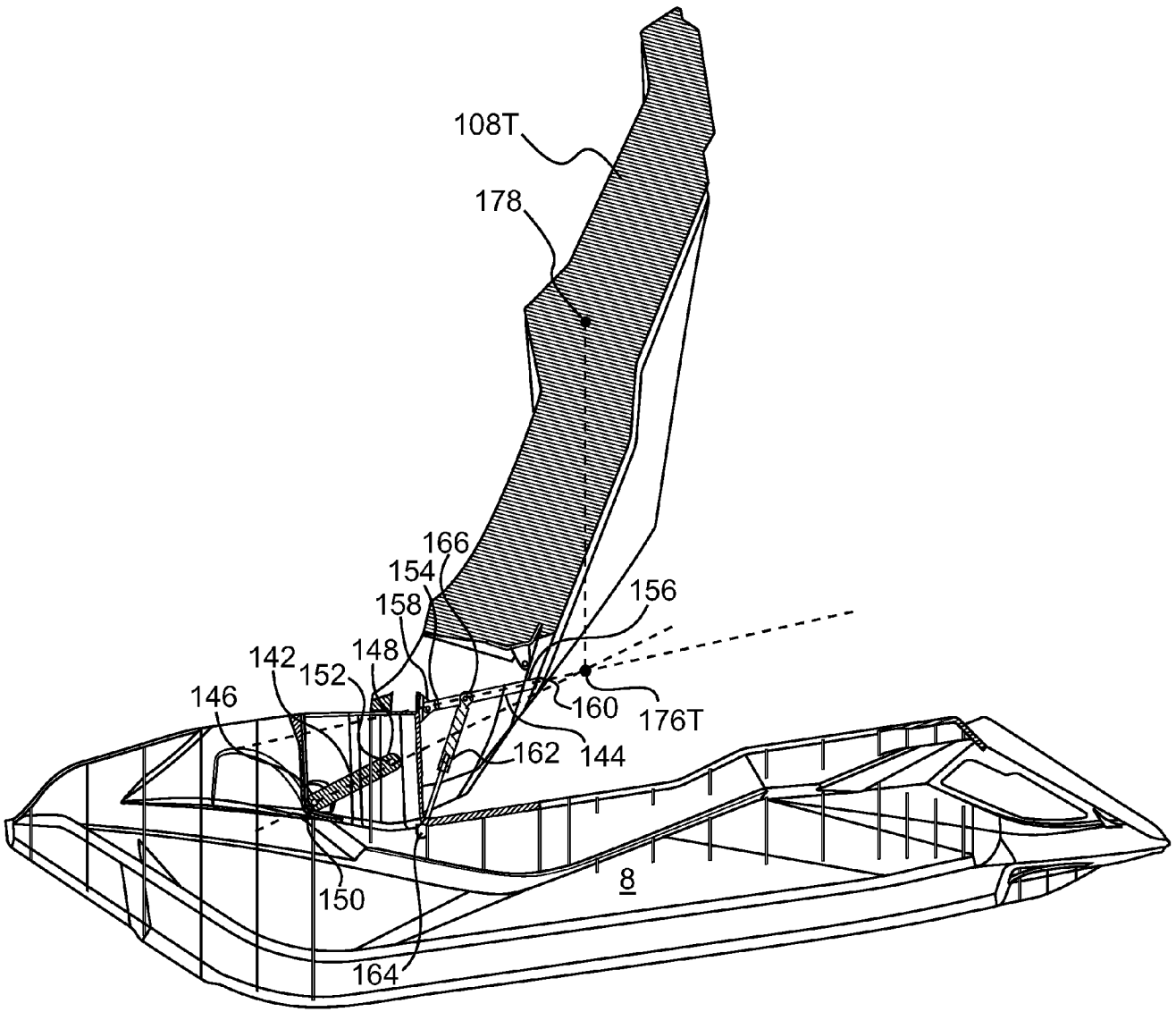
FIG. 20 is a partial cross-sectional view, taken from the left side, of the deck of the watercraft of FIG. 1, showing the seat in the toggle position.

Referring to FIG. 20, It should be understood that there exists a toggle position 108T of the seat 108, between the middle position 108M and the raised position 108R, at which point the instantaneous center 176 is vertically aligned with the center of gravity 178 of the seat 108. When the position of the seat 108 is above the toggle position 108T, the seat 108 will not pivot to a position below the toggle position 108T in the absence of an upward vertical force exerted thereon, because the center of gravity 178 of the seat 108 must initially move vertically upward as the seat pivots away from the raised position 108R to the toggle position 108T. When the position of the seat 108 is below the toggle position 108T, the seat pivots to the lowered position 108L under the force of gravity, though its decent is slowed by an upward force exerted thereon by the gas spring 162. It is contemplated that the gas spring 162 may exert an upward force on the seat 108 that is greater than the downward force due to the weight of the seat 108, in which case the seat 108 will not descend from the toggle position 108T to the lowered position 108L unless the rider exerts thereon a downward force. The gas spring 162 may optionally limit the range of pivotal movement of the seat 108 to a raised position 108R that is only slightly beyond the toggle position 108T, so that only a small upward vertical force needs to be exerted by a rider to overcome the toggle and return the seat 108 to the lowered position 108L. It is contemplated that the movement of the seat 108 beyond the raised position 108R may be limited in any other suitable manner, such as by a suitably positioned physical stop.

Referring again to FIG. 15, a number of rubber stops 180 are positioned on the deck 8 such that the seat 108 contacts the stops 180 when the seat 108 is in the lowered position 108L. The stops 180 support the weight of the seat 108 and the driver, passengers and/or any other load that is placed thereon during operation of the watercraft 2. As a result, the links 142, 144 are not solicited to bear the weight of the seat 108, and the stress on the links 142, 144 is reduced. It is contemplated that more or fewer stops 180 may be used, and the stops 180 may alternatively be made of any suitable material. It is further contemplated that that the seat 108 may rest directly on the deck 8 without the use of stops 180 when in the lowered position.

Figure 19:
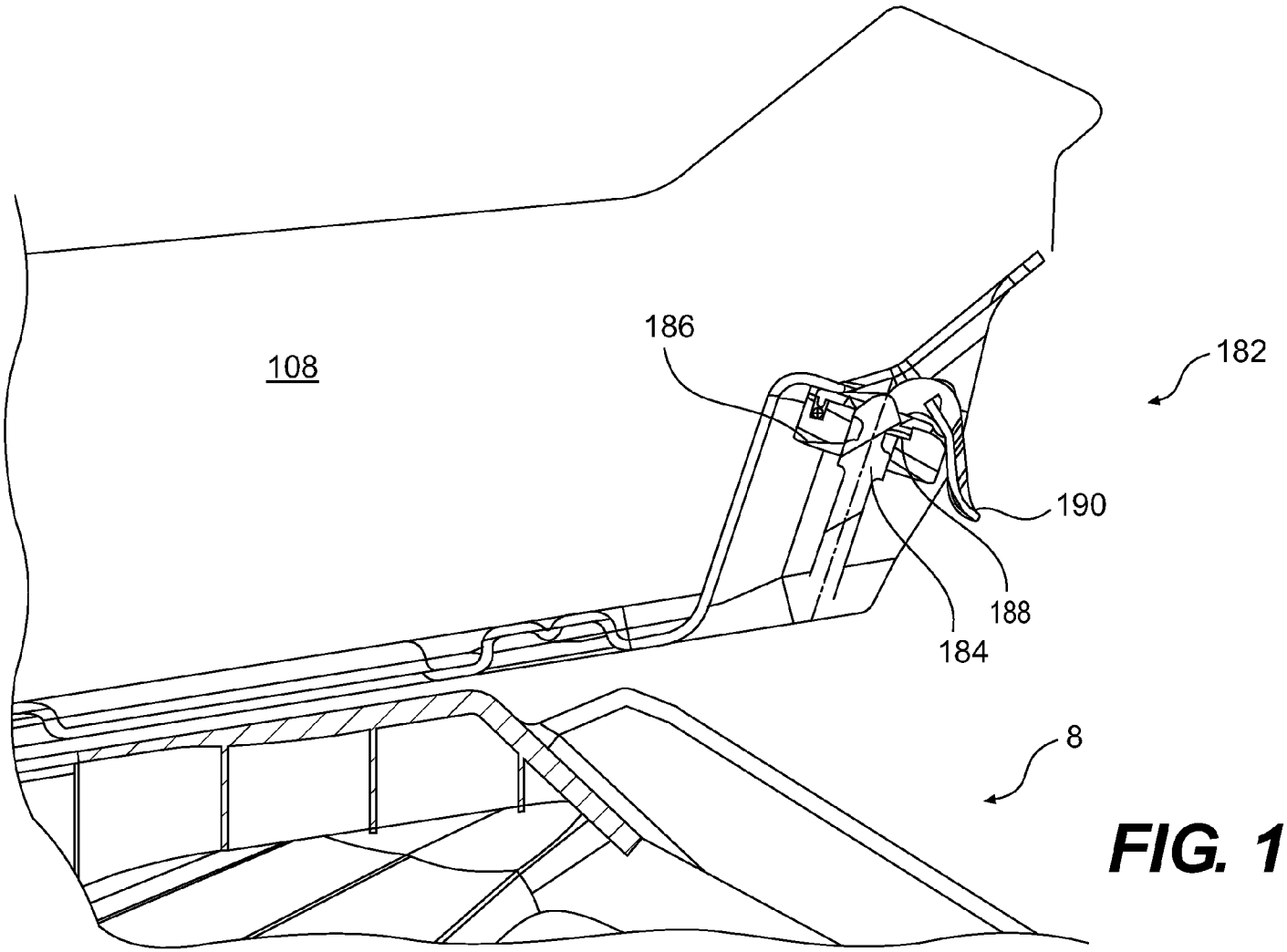
FIG. 19 is a left side elevation view of a latch assembly for a seat.

Referring now to FIG. 19, a latch assembly 182 at the rear of the seat 108 maintains the seat 108 in the lowered position 108L. The male connector of the latch assembly 182 is a pin 184 mounted to the rear portion of the deck 8 and the female connector is a ring 186 mounted to the rear portion of the seat 108. It is contemplated that the male connector 184 may alternatively be mounted to the seat 108, in which case the female connector 186 would be mounted to the deck 8. When the seat 108 is in the lowered position 108L, the female connector 186 receives the male connector 184. A latch 188 engages the male connector 184 and prevents the male connector 184 from exiting the female connector 186, thereby maintaining the seat 108 in the lowered position 108L. The latch 186 can be released by actuating the release lever 190, thereby permitting the seat 108 to be moved to the raised position 108R. The latch assembly 182 is preferably positioned and configured such that the stops 180 are compressed when the seat 108 is in the lowered position 108L. In this configuration, the seat 108 is firmly locked in the lowered position 108L, and the majority of the weight of the seat 108 and the driver, passengers and/or any other load that is placed thereon during operation of the watercraft 2 is borne by the stops 180 and not by the links 142, 144. It is contemplated that any suitable latch known in the art may alternatively be used.

Figure 21:
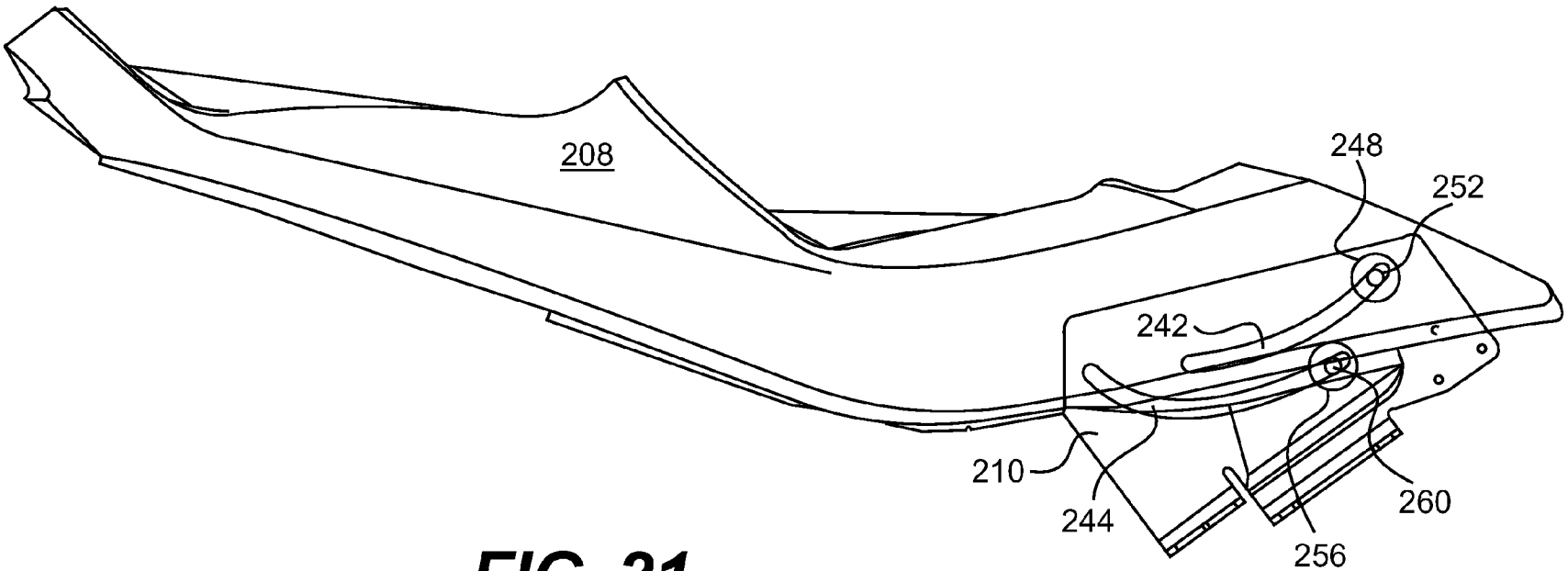
FIG. 21 is a right side elevation view of a seat linkage of the watercraft of FIG. 1 according to a second embodiment of the invention.

Referring now to FIG. 21, the connection between the seat 208 and the deck 8 will now be described according to a second embodiment. The seat 208 is pivotally mounted on the watercraft (not shown) via a first link 242 and a second link 244. In this embodiment, the first and second links 242, 244 have first and second tracks formed in a bracket 210 that is fixed to the deck (not shown) of the watercraft in a suitable manner. The seat 208 is mounted to the first link 242 via a first bushing 248. The seat 208 is pivotable with respect to the first link 142 about a first axis 252, defined by the center of the bushing 248 at its instantaneous location in the first track. The seat 208 is similarly mounted to the second link 244 via a second bushing 256. The seat 208 is pivotable with respect to the second link 244 about a second axis 260, defined by the center of the bushing 248 at its instantaneous location in the second track. The axes 252 and 260 are generally parallel and spaced apart. The tracks 242, 244 are shaped such that the pivotal movement of the seat 208 between the lowered position and the raised position (not shown) follows a path similar to that of the seat 108 of the watercraft 2.

It is contemplated that the first track 242 and the second track 244 may alternatively be formed in separate brackets that are both fixed to the deck 108. It is further contemplated that the seat 108 may alternatively have more than one coaxial first bushing 248 laterally spaced apart from one another, and more than one coaxial second bushing 256 laterally spaced apart from one another. Each first bushing 248 would be received in a respective first track 242 and each second bushing 256 would be received in a respective second track 244 in an appropriate number of brackets 210 fixed to the deck 8. It is further contemplated that the bushings 248, 256 may alternatively be fixed to the deck 8, in which case the brackets 210 would be fixed to the seat 108.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

an engine disposed generally in the hull;

a propulsion system connected to the hull and operatively connected to the engine;

a helm assembly operatively connected to the propulsion system;

a deck disposed above the hull, a straddle-type seat disposed on the deck at least in part rearwardly of the helm assembly;

the seat being pivotally connected to the deck via a pivotal connection and being pivotable with respect to the deck between a raised position having a raised seat angle and a lowered position having a lowered seat angle smaller than the raised seat angle;

the pivotal connection having first and second links;

the seat being pivotally connected to the first link and being pivotable with respect thereto about a first axis, the first axis being movable with respect to the deck;

the seat being pivotally connected to the second link and being pivotable with respect thereto about a second axis, the second axis being generally parallel to and spaced apart from the first axis, the second axis being movable with respect to the deck;

wherein when the seat is in the raised position:

the seat permits access to the engine via an aperture in the deck;

the first axis is in a first position; and the second axis is in a second position; and wherein when the seat is in the lowered position:

the seat covers the aperture in the deck and prevents access to the engine;

the first axis is in a third position forward of the first position; and the second axis is in a fourth position forward of the second position.

2. The personal watercraft of claim 1, wherein:

each of the first and second links has a first end and a second end;

the first end of the first link being pivotally connected to the deck and being pivotable with respect thereto about a third axis;

the second end of the first link being pivotally connected to the seat and being pivotable with respect thereto about the first axis;

the first end of the second link being pivotally connected to the deck and being pivotable with respect thereto about a fourth axis, the fourth axis being generally parallel to the third axis, the fourth axis being disposed rearwardly of the third axis;

the second end of the second link being pivotally connected to the seat and being pivotable with respect thereto about the second axis, the second axis being generally parallel to the first axis, the second axis being disposed rearwardly of the first axis.

3. The personal watercraft of claim 1, further comprising a sub-deck disposed on the hull, the hull and sub-deck together forming a hull and sub-deck (HSD) assembly, wherein:

the engine is disposed in the HSD assembly; and the deck is disposed above the sub-deck.

4. The personal watercraft of claim 1, wherein the seat is pivotable to a toggle seat position, the toggle seat position having a toggle seat angle smaller than the raised seat angle and larger than the lowered seat angle, wherein when the seat angle is larger than the toggle seat angle the seat does not pivot to a position having a seat angle smaller than the toggle seat angle under the force of its own weight.

5. The personal watercraft of claim 4, wherein when the seat angle is larger than the toggle seat angle the weight of the seat urges the seat toward the raised position.

6. The personal watercraft of claim 4, wherein when the seat angle is larger than the toggle seat angle the seat does not pivot to a seat position having a seat angle smaller than the toggle seat angle in the absence of an upward vertical force exerted thereon.

7. The personal watercraft of claim 4, wherein when the seat angle is smaller than the toggle seat angle the seat pivots to the lowered position under the force of its own weight.

8. The personal watercraft of claim 4, further comprising a gas spring operatively connected between the seat and the deck, wherein the gas spring exerts an upward force on the seat at least when the seat angle is smaller than the toggle seat angle.

9. The personal watercraft of claim 1, further comprising a gas spring operatively connected between the seat and the deck, wherein the gas spring exerts an upward force on the seat greater than the downward force exerted by the weight of the seat.

10. The personal watercraft of claim 4, further comprising a gas spring operatively connected between the seat and the deck, wherein when the seat is in the raised position the gas spring prevents the seat from pivoting to a seat position having a seat angle greater than the raised seat angle.

11. The personal watercraft of claim 4, wherein when the seat is in the raised position the first and second links prevent the seat from pivoting to a seat position having a seat angle greater than the raised seat angle.

12. The personal watercraft of claim 1, further comprising at least one compressible stop mounted to one of the seat and the deck, such that when the seat is in the lowered position the at least one stop abuts against the other of the seat and the deck.

13. The personal watercraft of claim 12, wherein the at least one stop is compressed by the seat when the seat is in the lowered position.

14. The personal watercraft of claim 13, wherein the at least one stop supports the majority of the weight of the seat when the seat is in the lowered position.

15. The personal watercraft of claim 1, wherein:

a rear portion of the seat has one of a male latch component and a female latch component;

a rear portion of the deck has the other of the male latch component and the female latch component;

the female latch component receiving the male latch component when the seat is in the lowered position, thereby preventing the seat from moving to the raised position.

* * * * *